US008418393B1

(12) United States Patent
Powers

(10) Patent No.: US 8,418,393 B1
(45) Date of Patent: Apr. 16, 2013

(54) MAGAZINE CAP RETENTION SYSTEM

(75) Inventor: Thomas P. Powers, Herkimer, NY (US)

(73) Assignee: RA Brands, L.L.C., Madison, NC (US)

( * ) Notice: Subject to any disclaimer, the term of this patent is extended or adjusted under 35 U.S.C. 154(b) by 0 days.

(21) Appl. No.: 13/272,827

(22) Filed: Oct. 13, 2011

(51) Int. Cl.
*F41C 23/00* (2006.01)

(52) U.S. Cl.
USPC ..... 42/85; 42/106

(58) Field of Classification Search ..... 42/17, 49.01, 42/49.02, 75.02, 85; 411/32, 51, 326, 327, 411/328, 329; 215/317, 330
See application file for complete search history.

(56) References Cited

U.S. PATENT DOCUMENTS

| | | | | |
|---|---|---|---|---|
| 2,402,086 | A * | 6/1946 | Rix | 42/75.02 |
| 2,521,257 | A * | 9/1950 | Sample | 411/329 |
| 2,834,390 | A * | 5/1958 | Stevens | 411/329 |
| 2,866,288 | A * | 12/1958 | Herter | 42/79 |
| 3,163,952 | A * | 1/1965 | Into | 42/75.01 |
| 3,777,383 | A | 12/1973 | Haines et al. | |
| 3,883,976 | A | 5/1975 | Norman et al. | |
| 4,087,930 | A * | 5/1978 | Grehl | 42/75.02 |
| 4,310,982 | A * | 1/1982 | Kast et al. | 42/75.02 |
| 5,613,316 | A * | 3/1997 | Hightower | 42/85 |
| 5,685,445 | A * | 11/1997 | Dobbs | 215/330 |
| 6,385,891 | B1 * | 5/2002 | Rabatin | 42/79 |
| 6,557,290 | B2 * | 5/2003 | Kumler | 42/79 |
| 7,393,169 | B2 * | 7/2008 | SuBenbach | 411/38 |
| 2003/0010160 | A1 * | 1/2003 | Dugan | 81/446 |

OTHER PUBLICATIONS

International Search Report for PCT/US2012/059540 dated Jan. 7, 2013.
Written Opinion for PCT/US2012/059540 dated Jan. 7, 2013.

* cited by examiner

*Primary Examiner* — Michael Carone
*Assistant Examiner* — Derrick Morgan
(74) *Attorney, Agent, or Firm* — Womble Carlyle Sandridge & Rice, LLP

(57) ABSTRACT

A firearm and a method for configuring the firearm is described that, in one aspect, includes a tubular magazine having a mechanical connection arranged at one end, a cap having a mechanical connection and configured to cooperate with the mechanical connection arranged on the one end of the tubular magazine, a retaining mechanism arranged in the tubular magazine having a circumferential surface, the retaining mechanism having retaining mechanism locking components arranged on the circumferential surface, and the cap further including an internal peripheral surface having cap locking components arranged along the internal peripheral surface, the retaining mechanism locking components and the cap locking components configured to interact to keep the cap from rotating thereby preventing the cap from accidentally disconnecting from the tubular magazine.

24 Claims, 6 Drawing Sheets

MAGAZINE CAP RETENTION SYSTEM

BACKGROUND OF THE DISCLOSURE

1. Field of the Disclosure

The disclosure is directed to devices and methods for a magazine cap retention system for a firearm. In particular, the disclosure is directed to a magazine cap retention system that prevents the magazine cap from loosening during shooting and other activities.

The ability to not loosen is accomplished by using a more robust system that, for example, does not disengage during shooting. Such a system may include an extended mechanical connection. The extended mechanical connection allows components to move in one aspect but not move in other aspects. For example, the extended mechanical connection may be a circumferential "spline" tooth-form. This tooth-form has a greater length of engagement, which can be limited, so the locking features of the two components never disengage during shooting. Other implementations are contemplated.

2. Related Art

Certain shoulder firearms such as repeating shot-guns include tubular magazines secured to the forward end of a receiver. The magazine tube is commonly enclosed within a fore-end. Shotgun shells are loaded into a magazine tube and are spring biased toward the receiver so as to permit reloading after firing. The forward end of the magazine tube is closed by a threaded cap. This cap also constitutes the forward abutment for the fore-end so that a tightly threaded cap will securely maintain the fore-end stock in place.

During normal use of prior art firearms, the actions of the barrel recoil upon firing, ejection of the fired shell and subsequent reload tend to loosen the magazine cap. Without some additional mechanism, the cap can come completely off, thereby causing the spring and associated parts within the magazine tube to come apart.

Several types of systems have been used in the past to prevent loosening of the magazine cap. One prior art method of mechanical engagement includes a circular "wave" tooth-form, that is predisposed in an axial orientation as disclosed in U.S. Pat. No. 4,310,982 to Jack L. Kast, assigned to the assignee of the invention. During firearm recoil, the "spring-loaded" Magazine Spring Retainer, which engages the tooth-form in the magazine cap, may disengage the tooth-form, thereby allowing the magazine cap to rotate, and eventually become loose. This occurrence is mostly a function of the amount of engagement of the tooth-form, and the amount of recoil of the firearm.

Another technique is described in U.S. Pat. No. 2,402,086 to Leon A. Rix, assigned to the assignee of the invention, wherein the fore-end of the tube has a bushing brazed thereon provided with a circumferential series of ratchet teeth. A separate detent washer with a circumferential series of ratchet teeth is biased by the magazine spring against the inner end of the bushing so as to mesh with its ratchet teeth. The detent washer is provided with a protrusion which is intended to fit into a slot in the magazine cap so that, as the cap is tightened, the slot will engage the projection. Further tightening of the cap causes the teeth of the detent washer to engage those of the bushing until they are in fully seated meshing engagement. The cap is thus resiliently held against turning relative to the magazine tube.

Another system is the subject of U.S. Pat. No. 4,087,930 to William H. Grehl, in which the magazine spring urges two projecting prongs or fingers of a detent member at the fore-end of the magazine tube into engagement with a slotted or notched surface along the inner periphery of the magazine cap. In this system, the spring retainer is a separate element from the detent member and the former must be friction fit to the wall of the magazine tube.

In yet another prior art system, a single detent is located along the circumference of a metal frame located within the fore-end stock. The detent is biased by its own spring to engage slots along the outer periphery of the magazine cap and thus detent the latter.

SUMMARY OF THE DISCLOSURE

The invention meets the foregoing need and provides a method and apparatus that prevents the magazine cap from loosening during shooting, especially during the shooting of "heavy" loads. This avoids the problem of when the magazine cap loosens, the fore-end becomes loose and that furthermore includes other advantages apparent from the discussion herein. The invention may be implemented in a number of ways.

According to one aspect of the invention, a firearm is provided that includes a tubular magazine having a mechanical connection arranged at one end; a cap having a mechanical connection and configured to cooperate with the mechanical connection arranged on the one end of the tubular magazine; a retaining mechanism arranged in the tubular magazine having a circumferential surface, the retaining mechanism having retaining mechanism locking components arranged on the circumferential surface; and the cap further comprising an internal peripheral surface having cap locking components arranged along the internal peripheral surface, the retaining mechanism locking components and the cap locking components configured to interact to keep the cap from rotating thereby preventing the cap from accidentally disconnecting from the tubular magazine.

In another aspect, a method of configuring a firearm includes arranging a tubular magazine having a mechanical connection arranged at one end, arranging a cap having a mechanical connection and configured to cooperate with the mechanical connection arranged on the one end of the tubular magazine, arranging a retaining mechanism arranged in the tubular magazine having a circumferential surface, the retaining mechanism having retaining mechanism locking components arranged on the circumferential surface, arranging the cap further comprising an internal peripheral surface having cap locking components arranged along the internal peripheral surface, the retaining mechanism locking components and the cap locking components configured to interact to securely hold the cap on the tubular magazine, and configuring the retaining mechanism locking components and the cap locking components to move respect to one another, but not allow the cap to rotate.

In another aspect, a firearm includes a tubular magazine having a mechanical connection arranged at one end, a cap having a mechanical connection and configured to cooperate with the mechanical connection arranged on the one end of the tubular magazine and a retaining mechanism arranged in the tubular magazine having a plurality of locking components, wherein the cap is configured with a plurality of cap locking components, the plurality of cap locking components configured to interact with the retaining mechanism having a plurality of locking components to keep the cap from counter-rotating thereby preventing the cap from accidentally disconnecting from the tubular magazine during use, and the retaining mechanism having a plurality of locking components and the plurality of cap locking components being configured to slideably interact to permit relative motion between the cap and the tubular magazine.

Additional features, advantages, and embodiments of the disclosure may be set forth or apparent from consideration of the following detailed description, drawings, and claims. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the disclosure, are incorporated in and constitute a part of this specification, illustrate embodiments of the disclosure and together with the detailed description serve to explain the principles of the disclosure. No attempt is made to show structural details of the disclosure in more detail than may be necessary for a fundamental understanding of the disclosure and the various ways in which it may be practiced. In the drawings.

DETAILED DESCRIPTION OF THE DISCLOSURE

Figure 1:
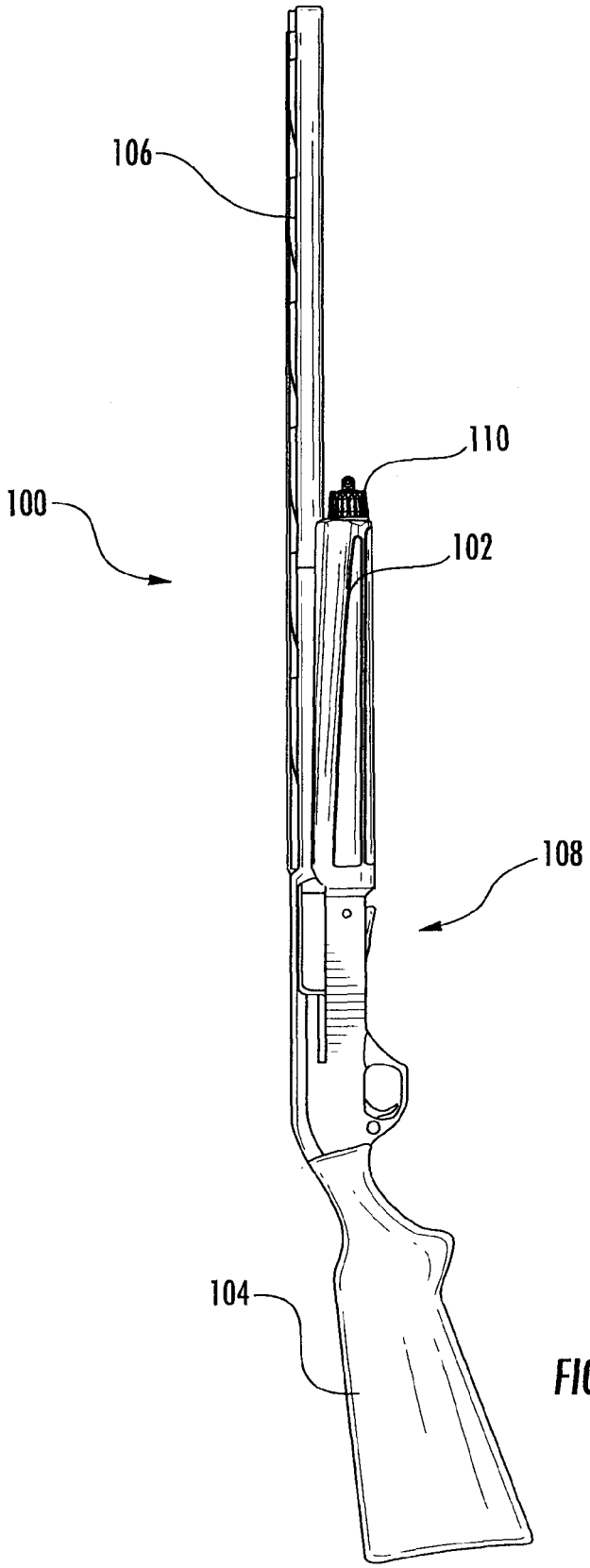
FIG. 1 shows a firearm using the retention mechanism constructed according to the principles of the invention.

The embodiments of the disclosure and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure, which is defined solely by the appended claims and applicable law. Moreover, it is noted that like reference numerals represent similar parts throughout the several views of the drawings.

The magazine cap retention system disclosed herein prevents disengagement of the interlocking elements, thereby preventing loosening of the magazine cap during shooting. This system includes at least two components. These components may be used as replacement components that may retrofit a firearm with no other modifications.

Figure 2:
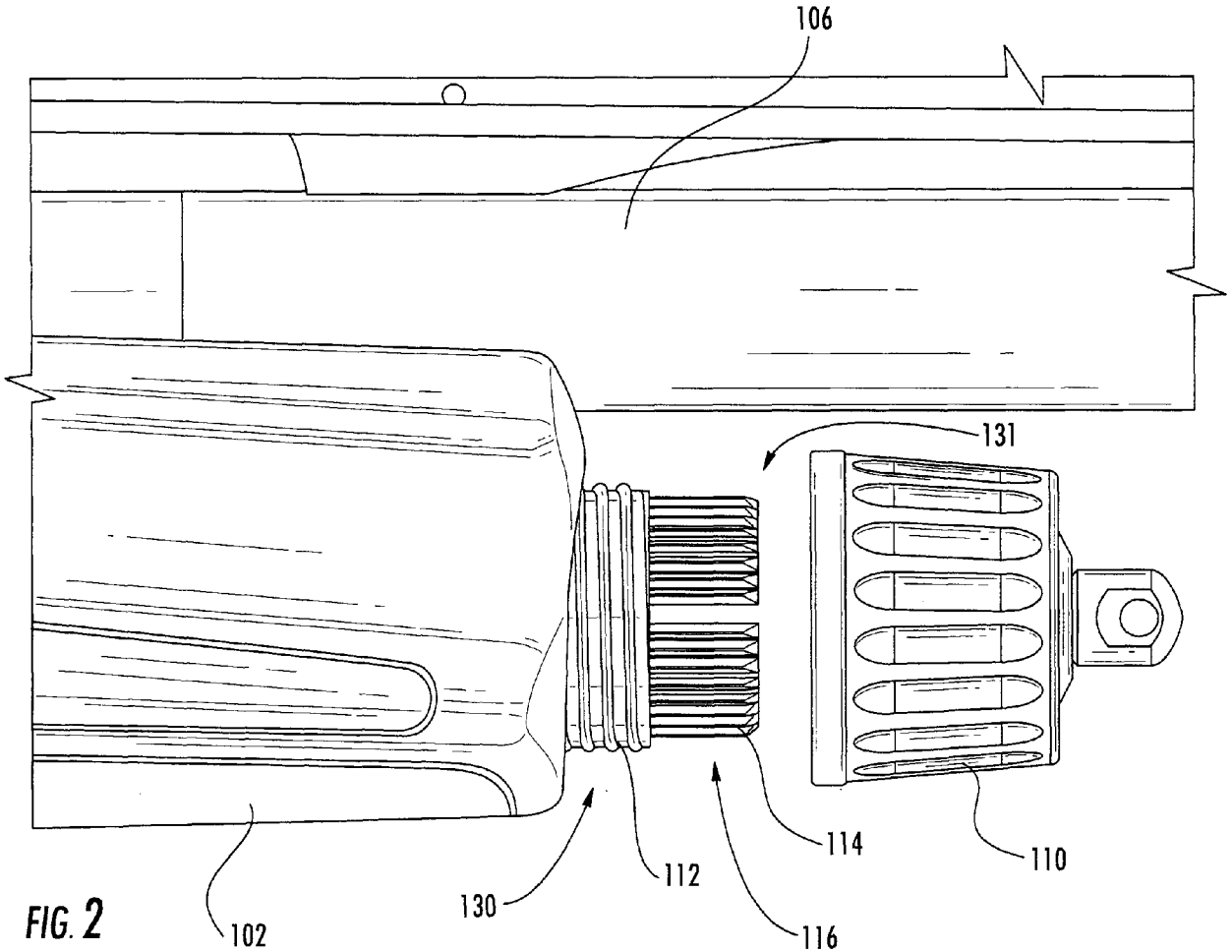
FIG. 2 shows a detailed view of a portion of the firearm constructed according to the principles of the invention showing the retention mechanism with cap removed.

FIG. 1 shows a firearm using the retention mechanism constructed according to the principles of the invention; and FIG. 2 shows a detailed view of a portion of the firearm constructed according to the principles of the invention showing the retention mechanism with cap removed. In particular, FIG. 1 shows the fore-end 102 of a shotgun 100 incorporating an aspect of the invention. As is common in shotguns, a tubular magazine or magazine tube 130 (shown in FIG. 2) may be located below the gun barrel 106 within the fore-end 102. One end of the magazine tube 130 fits into an opening in the receiver 108 for feeding shotgun shells to the reloading mechanism of the gun 100. A magazine spring (not shown) within the tubular magazine 130 presses rearwardly against a magazine follower (not shown), which in turn will continuously exert a rearward force against a column of shotgun shells which may be loaded in the magazine tube 130.

As shown in FIG. 2, the fore-end 102 may surround the tubular magazine 130 and a cap 110 may be screwed onto the threaded end 112 of the magazine tube 130 projecting a short distance beyond the fore-end 102. As the cap 110 is tightened, it engages the end of the fore-end 102 and forces it rearward to assist in holding the fore-end 102 securely in place. When the cap 110 is unscrewed and removed from the threaded end 112 of the magazine tube 130, the fore-end 102 may be slipped forward to expose the tubular magazine 130 and other portions of the firearm 100.

The foregoing general arrangement of the fore-end 102 portion of a firearm 100 with a tubular ammunition magazine 130 is typical of such shotguns. The invention is also applicable to types of tubular magazine firearms such as, for example, slide and pump action guns wherein the fore-end is moved longitudinally for reciprocating the breech-bolt and actuating the reloading mechanism.

Referring more particularly to FIG. 2, the components of a fore-end magazine tube assembly 131 of the invention are illustrated in a partial non-assembled state. These include the tubular magazine or magazine tube 130, the cap 110, a retainer member 116, and the magazine spring 160 (FIG. 3) described above and located within the magazine tube 130. It should be noted that the magazine tube 130 may have one or more projections 144 (FIG. 3) extending inwardly along its interior surface and located near the threaded end 112.

Figure 3:
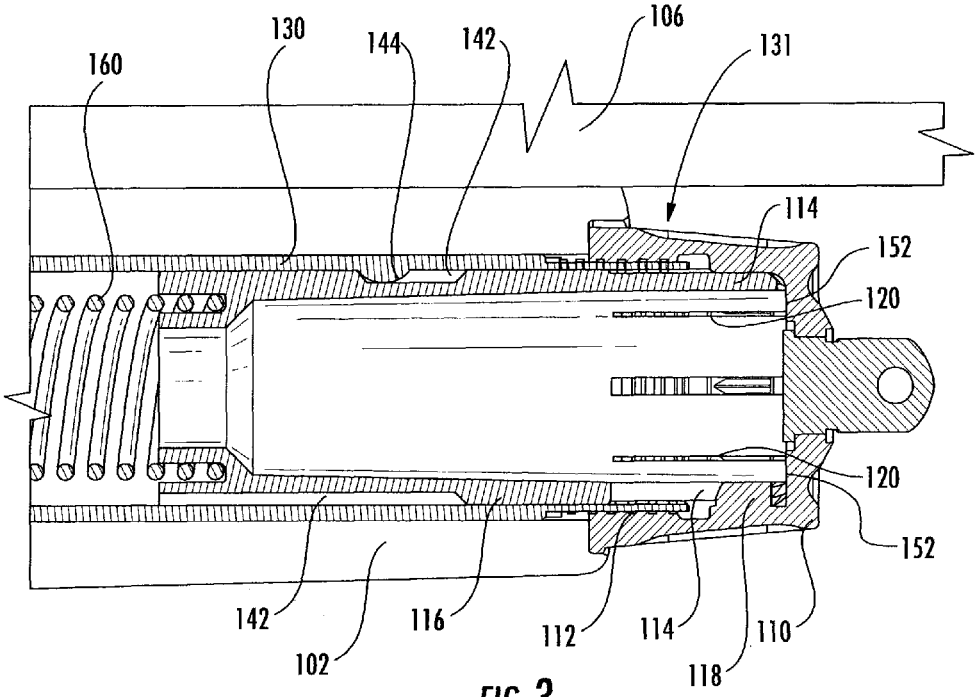
FIG. 3 shows a cross-section of the retention mechanism of the invention constructed according to the principles of the invention.

Included in the fore-end magazine tube assembly 131 is the cylindrical shaped retainer member 116. The retainer member 116 serves a dual function. The primary function of the retainer member 116 is to retain the magazine spring 160 (FIG. 3). A secondary function is to engage the magazine cap. For example, the retainer member 116 may retain the magazine spring in the magazine tube 116 when the cap 110 is removed. The retainer member 116 also employs the spring force of the magazine spring to maintain the retainer member 116 in a position to engage the magazine cap 110, thereby preventing the magazine cap from loosening by employing principles described herein. The retainer member 116 includes retainer spline teeth 114 that extend through the front opening of the magazine tube 130.

FIG. 3 shows a cross-section of the retainer member or retainer 116 of the invention of the firearm constructed according to the principles of the invention. In FIG. 3, the retainer 116 is shown properly aligned within the magazine tube 130 for assembly of the components of the fore-end magazine tube assembly 131. Projection 144 extends inwardly from the interior surface of the magazine tube 130 and is initially lined up within the channel 142 of the retainer 116 so that the retainer 116 may be held in the magazine tube 130.

The magazine cap 110 may be screwed onto the threaded end 112 of the magazine tube 130. Other mechanical fastening approaches are contemplated. When the cap 110 is screwed tight, the spline teeth 114 of the retainer 116 to engage cap spline teeth 118 constructed inside of the cap 110 (see FIG. 5). The spline teeth 114 of the retainer 116 and cap spline teeth 118 along the inside periphery of the magazine cap 110 may have matching teeth. The retainer spline teeth 114 and the cap spline teeth 118 are constructed to mutually slide longitudinally along one another. When the cap 110 is tightened, the spring bias of arms 152 on the retainer 116 causes the axially-aligned tooth serrations or surfaces of the retainer spline teeth 114 and the cap spline teeth 118 to intermesh and thus inhibit the cap 110 from rotating with respect to the retainer 116. The retainer 116 thus acts to prevent the magazine cap 110 from coming unscrewed during normal use by causing the retainer spline teeth 114 at a circumferential surface of the end of the retainer member 116 to interact with the corresponding cap spline teeth 118 disposed at an inner periphery of the magazine cap 110 (FIG. 3). Both the retainer spline teeth 114 and the cap spline teeth 118 may be in the form of a circumferential series of serrations with intermeshing pointed teeth. However, other mechanical configurations are also contemplated.

In one aspect, the contact surfaces of the retainer spline teeth 114 and the cap spline teeth 118 are in releasable contact with one another and engaged with one another along their mutual extents. The magazine cap 110 may be removed by manual intervention so that manual force exerted by a user when unscrewing the magazine cap 110 may overcome the holding resistance provided by the mutually engaged retainer spline teeth 114 and cap spline teeth 118, thereby permitting the removal of the magazine cap. Conversely, when screwing the magazine cap 110 onto the retainer member 116, the force or torque exerted by the user may overcome the resistance provided by the mutually engaged retainer spline teeth 114 and cap spline teeth 118 to permit tightening of the magazine cap 110.

Figure 4:
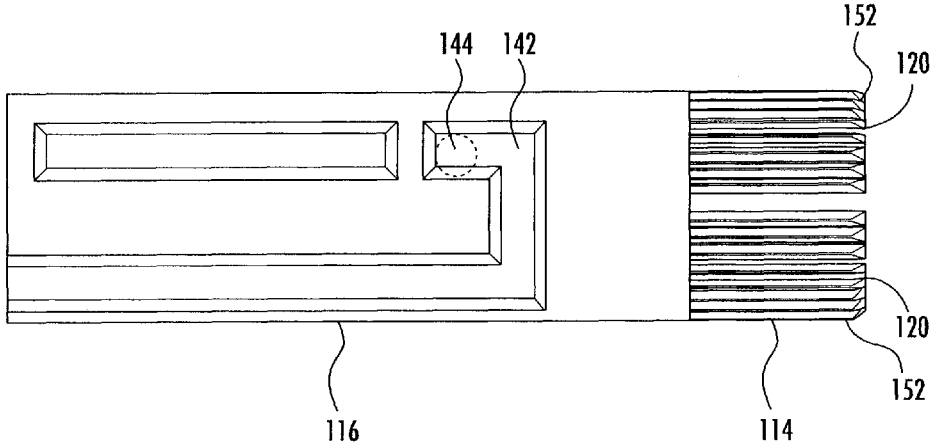
FIG. 4 shows a portion of the retention mechanism constructed according to the principles of the invention.

FIG. 4 shows a portion of the retaining mechanism or retainer 116 constructed according to the principles of the invention. In particular, slots 120 form arms 152. The arms 152 may be normally biased so that retainer spline teeth 114 may be engaged by the cap spline teeth 118 of the magazine cap 110 (FIG. 3). The arms 152 may also be moved radially inwardly by the spline teeth 118 of the magazine cap 110 during rotation of the cap 110 by the user in order to remove cap 110 when desired. The arms 152 may be substantially separated from one another along a portion of their extents. FIG. 4 further illustrates a channel 142 of the retainer 116 which is configured to receive a projection 144 (shown in outline) extending inwardly from the inside surface of the magazine tube.

Figure 5:
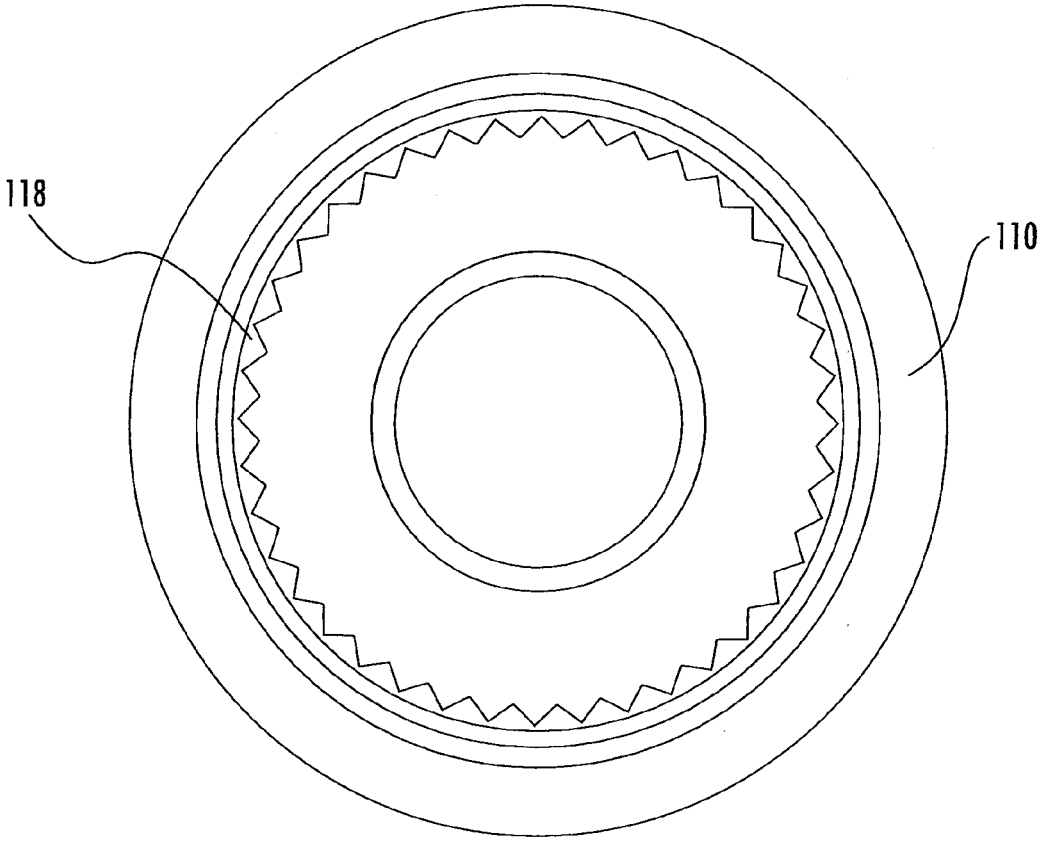
FIG. 5 shows the internal construction of the cap constructed according to the principles of the invention.

FIG. 5 shows the internal construction of the cap according to the principles of the invention. In particular, FIG. 5 shows the cap 110 and the arrangement of the spline teeth 118.

Figure 6:
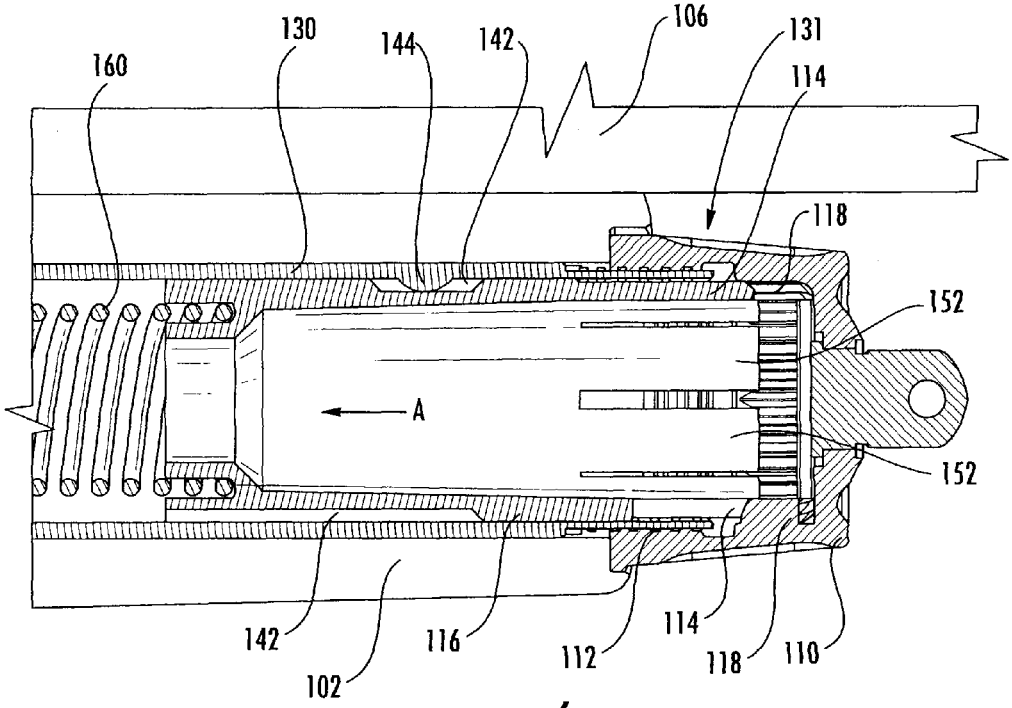
FIG. 6 shows a cross-section of the retention mechanism during a recoil action.

In particular, FIG. 6 shows the retainer mechanism 116 of the fore-end magazine tube assembly 131 moving in the direction of arrow A, as may occur during certain activities such as shooting heavy loads. Note that retaining mechanism 116 has moved to the left with respect to the magazine tube 130 and the cap 110. The illustrated distance of movement shown is exemplary and other distances may occur depending on the load involved. However, the spline teeth 114 of the retainer mechanism 116 and the spline teeth 118 of the cap 110 remain slidably engaged during the axial motion of the retainer mechanism 16 to reduce the possibility that the cap 110 will rotate and loosen undesirably.

The method of manufacture of the retainer member 116 may be by injection molding of plastic. Composites may also be employed. The method of manufacture of the magazine cap 110 may be turned metal bar-stock (screw-machine), or composites. The "teeth" may be formed with a rotary-broach process. Other methods of manufacture are contemplated.

While the particular embodiments of the invention have been described for purposes of illustration, it will be understood that various changes and modifications can be made therein within the spirit of the invention, and the invention accordingly is not to be taken as limited except by the scope of the appended claims.

In one aspect, the invention also includes the method of engagement of the cap 110 that does not disengage, as a result of component movement during the recoil (or counter-recoil) of the firearm. Additionally, it should be noted that the longitudinal "teeth" (or "female" locking feature) may be contained within the magazine cap 110, or the retainer 116. The locking feature need not be a "mirror-image" tooth-form, but could be a spring-loaded ball, or plurality of balls (or other similar geometry), capable of engaging and staying engaged with a mating component.

While the disclosure has been described in terms of exemplary embodiments, those skilled in the art will recognize that the disclosure can be practiced with modifications in the spirit and scope of the appended claims. These examples given above are merely illustrative and are not meant to be an exhaustive list of all possible designs, embodiments, applications or modifications of the disclosure.

What is claimed is:

1. A firearm that comprises:

a tubular magazine having a longitudinal axis, a forward end, and a first mechanical connection adjacent the forward end;

a retaining mechanism arranged in the tubular magazine and having a circumferential surface extending from the forward end of the magazine, the retaining mechanism having a plurality of retaining mechanism locking components arranged on the circumferential surface each of the retaining mechanism locking components extending substantially parallel with the longitudinal axis; and a cap adapted to be received over the first circumferential surface and having a second mechanical connection configured to engage the first mechanical connection to couple the cap to the tubular magazine, the cap further including a plurality of cap locking components arranged along an internal surface of the cap and configured to engage the locking components of the retaining mechanism, wherein the retaining mechanism locking components and the cap locking components are configured to radially engage so as to resist rotation between the cap and the retaining mechanism when the cap is couple to the forward end of the tubular magazine.

2. The firearm as defined in claim 1 wherein the first mechanical connection comprises threads and the second mechanical connection comprises threads.

3. The firearm as defined in claim 1 wherein the retaining mechanism locking components comprise spline teeth.

4. The firearm as defined in claim 3 wherein the cap locking components comprise spline teeth that engage the spline teeth of the retaining mechanism.

5. The firearm as defined in claim 1 wherein the retaining mechanism further comprises a series of arms that are substantially parallel with the longitudinal axis.

6. The firearm as defined in claim 5 wherein the arms are biased toward engagement with the internal surface of the cap when the cap is applied thereover.

7. The firearm as defined in claim 5 wherein the arms are configured to flex radially inwardly to allow the cap to rotate when a force sufficient to overcome a holding resistance between the locking components of the cap and the retaining mechanism is applied to the cap.

8. The firearm as defined in claim 1 wherein the engagement between the retaining mechanism locking components and the cap locking components is configured to allow relative sliding motion between the cap and the retaining mechanism while resisting rotation between the cap and the retaining mechanism.

9. The firearm of claim 8, wherein the relative sliding motion permits sliding motion along a length of the interacting locking components between the retaining mechanism and the cap.

10. The firearm of claim 1, wherein the retaining mechanism locking components and the cap locking components are configured to permit manual removal of the cap from the tubular magazine.

11. A method of configuring a firearm comprises:

arranging a tubular magazine within a fore-end of the firearm, the tubular magazine having a longitudinal axis, a forward end, and a first mechanical connection adjacent the forward end;

placing a retaining mechanism in the tubular magazine, with a first circumferential surface of the retaining mechanism extending from the forward end of the magazine, the first circumferential surface having a plurality of retaining mechanism locking components extending substantially parallel with the longitudinal axis of the magazine;

moving a cap over the first circumferential surface of the retaining mechanism and proximate the first mechanical connection of the magazine, the cap having a second mechanical connection configured to engage the first mechanical connection, and further including a plurality of cap locking components arranged along an internal surface of the cap and configured to radially engage the locking components of the retaining mechanism to create a resistance to rotation between the cap and the retaining mechanism; and applying a force to the cap that is sufficient to overcome the resistance to rotation between the locking components of the cap and the locking components of the retaining mechanism and engaging the second mechanical connection with the first mechanical connection to couple the cap to the tubular magazine.

12. The method of configuring a firearm as defined in claim 11 wherein the first magazine mechanical connection comprises threads and second mechanical connection comprises threads.

13. The method of configuring a firearm as defined in claim 11 wherein the retaining mechanism locking components comprise spline teeth.

14. The method of configuring a firearm as defined in claim 11 wherein the cap locking components comprise spline teeth that engage the spline teeth of the retaining mechanism.

15. The method of configuring a firearm as defined in claim 11 wherein the retaining mechanism proximate the first circumferential surface further comprises a series of arms that are substantially parallel with the longitudinal axis.

16. The method of configuring a firearm as defined in claim 15 wherein the arms are normally biased to engage the second circumferential surface of the cap.

17. The method of configuring a firearm as defined in claim 15 wherein the arms are configured to flex radially inwardly to allow the cap to rotate when the applied force is greater than the holding resistance between the locking components of the cap and retaining mechanism.

18. A firearm comprising:

a barrel;

a magazine spring;

a magazine tube extending along a portion of the barrel and adapted to receive the magazine spring therein, the magazine tube defining a longitudinal axis, and having a forward end, and a first mechanical connection adjacent the forward end;

a retainer received within the forward end of the magazine tube, the retainer having a proximal end received in the magazine tube and a distal end extending from the forward end of the magazine tube, the distal end including a plurality of first locking components; and a cap adapted to be received over the distal end of the retainer and having a second mechanical connection configured to engage the first mechanical connection of the magazine tube to couple the cap to the magazine tube, the cap further including a series of second locking components arranged along a circumferential surface of the cap and configured to radially engage with the first locking components of the retainer, wherein the radial engagement between the first locking components of the retainer and the second locking components of the cap allows for axial movement between the locking cap and the retainer while creating a holding resistance that resists rotation between the locking cap and the retainer.

19. The firearm of claim 18, wherein each of the plurality of first locking components includes contact faces that are substantially parallel with the longitudinal axis.

20. The firearm of claim 18, wherein the radial engagement between the first locking components and second locking components is configured to resist rotation between the cap and the retainer in response to forces applied to the cap that are less than the holding resistance, and to allow rotation between the cap and the retainer when the applied force is greater than the holding resistance.

21. The firearm of claim 20, wherein the retainer further comprises a series of spaced arms that extend substantially parallel with the longitudinal axis.

22. The firearm of claim 21, wherein the arms are normally biased to engage the circumferential surface of the cap.

23. The firearm of claim 22, wherein the arms are configured to flex radially inwardly to allow the cap to rotate when the applied torque is greater than the torque threshold.

24. The firearm of claim 18, wherein the proximal end of the retainer engages the magazine spring, which biases the retainer toward the cap.

* * * * *